United States Patent [19]

Hamner

[11] Patent Number: 4,875,992

[45] Date of Patent: Oct. 24, 1989

[54] PROCESS FOR THE PRODUCTION OF HIGH DENSITY JET FUEL FROM FUSED MULTI-RING AROMATICS AND HYDROAROMATICS

[75] Inventor: Glen P. Hamner, Baton Rouge, La.

[73] Assignee: Exxon Research and Engineering Company, Florham Park, N.J.

[21] Appl. No.: 134,798

[22] Filed: Dec. 18, 1987

[51] Int. Cl.[4] ..... C10G 45/50

[52] U.S. Cl. ..... 208/89; 208/58; 208/60; 208/16; 208/144; 585/260; 585/411

[58] Field of Search ..... 208/144, 60, 89, 58, 208/16

[56] References Cited

U.S. PATENT DOCUMENTS

| | | | |
|---|---|---|---|
| 3,594,307 | 7/1971 | Kirk, Jr. et al. | 208/57 |
| 3,607,729 | 9/1971 | Robinson et al. | 208/89 |
| 4,342,641 | 8/1982 | Reif et al. | 208/57 |
| 4,427,534 | 1/1984 | Brunn et al. | 208/89 |

*Primary Examiner*—H. M. S. Sneed

*Assistant Examiner*—Helane Myers

*Attorney, Agent, or Firm*—Roy J. Ott

[57] ABSTRACT

A process for the conversion of a feed rich in fused two-ring aromatic and fused two-ring hydroaromatic hydrocarbons, notably light cat cycle oil, furnance oils, coal liquids, tar sands liquids, shale oil liquids, and the like to high density jet fuels. Sulfur or nitrogen, or both are removed from said feed and a hydrodesulfurized/-hydrodenitrogenated liquid product separated therefrom is hydrotreated in a second stage over a highly active fluorided Group VIII metal-on-alumina catalyst at conditions sufficient to selectively hydrogenate and saturate the fused two-ring aromatics and/or partially saturated fused two-ring hydroaromatics at high selectivity to naphthenes without any significant conversion thereof to lower molecular weight hydrocarbons. High density jet fuels having an API gravity ranging from about 25 to about 35, with a total aromatic content well below about 50 percent, preferably 5 percent to about 30 percent, are produced.

16 Claims, 1 Drawing Sheet

FIGURE
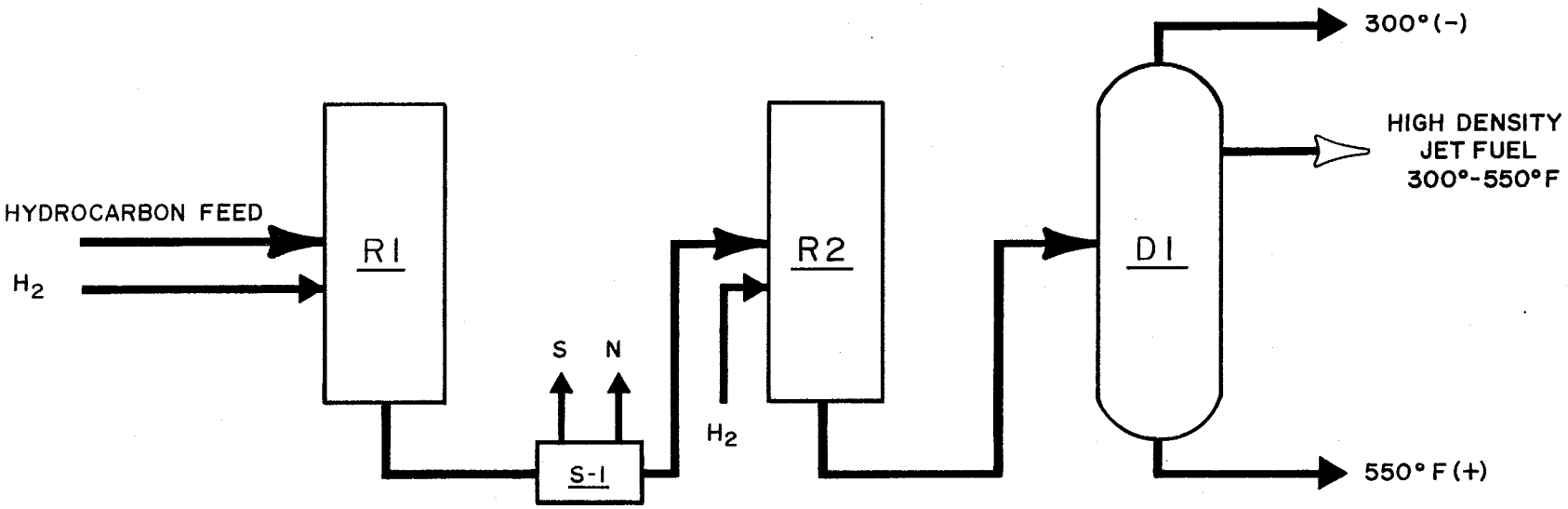

PROCESS FOR THE PRODUCTION OF HIGH DENSITY JET FUEL FROM FUSED MULTI-RING AROMATICS AND HYDROAROMATICS

BACKGROUND OF THE INVENTION

I. Field of the Invention

This invention relates to a process for the production of a high density jet fuel from a feed comprised of fused multi-ring aromatic hydrocarbons, or fused multi-ring hydroaromatic hydrocarbons, or both. In particular, it relates to the production of high density jet fuels from feedstocks containing large concentrations of fused two-ring aromatic or hydroaromatic compounds, or both, especially a hydrocarbon feed fraction boiling within a range of about 300° F. to 550° F., and more particularly from about 300° F. to 525° F.

II. Background and Problems

The preponderance of fused multi-ring aromatic or hydroaromatic hydrocarbons, or hydrocarbons which contain two or more fused aromatic or hydroaromatic rings, are found in mid-distillate fuel fractions produced in the refining of petroleum, or synthetic fuel fractions generally analogous thereto which are obtained from coal liquids, tar sands, shale oils and like materials. These compounds are substantially excluded from motor gasoline inasmuch as they produce carbonaceous deposits when burned in internal combustion engines. In burning, the fused multi-ring aromatics are directly converted to carbon, and the fused multi-ring hydroaromatics are dehydrogenated back into their corresponding parent fused multi-ring aromatic hydocarbons, respectively, and then converted to carbon; the same end result. The latter reaction is particularly favored at high temperatures such as prevails in internal combustion engines.

The presence of a small fraction of the fused two-ring aromatic or fused two-ring hydroaromatic hydrocarbons in gasolines, however, is often tolerated, since these compounds generally provide acceptable octane, and it is difficult to remove all of these compounds from the gasolines with any degree of economy. Their presence in gasolines, however, is costly in that their presence results in increased carbon deposition in internal combustion engines. The two-ring hydroaromatic hydrocarbon and higher boiling fused multi-ring aromatic and hydroaromatic hydrocarbons which contain three or more fused rings (sometimes termed PNA's for polynuclear aromatic hydrocarbons), obtained from refinery process streams are often blended into distillate fuels even though their cetane values are low, or further processed to make gasoline. In the former case, e.g., a light cat cycle oil, the product of a catalytic cracker rich in fused two-ring hydrocarbons, is often blended with high quality kerosene to upgrade the former and produce diesel fuel. In the latter case, a light cat cycle oil, boiling between about 400° F. and 750° F. is hydrotreated, and the product of the hydrotreating is hydrocracked to coproduce predominately naphtha and some jet fuel and diesel fuel.

In the coproduction of jet and diesel fuels, with gasoline, typically a light cat cycle oil, boiling within a range of from about 400° F. to 750° F., is hydrotreated in a first reactor over a catalyst containing a Group VIB or Group VIII metal, or both, to remove a preponderance of the sulfur and nitrogen. The liquid product from the hydrotreater is then hydrocracked to lower boiling or lower molecular weight hydrocarbons. Hydrocracking is a high severity hydrotreating operation employing an acidic base catalyst such as a faujasite or silica alumina containing Group VIII metal or Group VIB and combinations thereof to produce naphtha as the primary product. The sulfur and nitrogen thus are generally removed from the product as $H_2S$ and $NH_3$ by passage to a flash drum, or the total sour gas and product, is then conducted to a hydrocracker and reacted at high severity over a hydrocracking catalyst, e.g., a palladium-on-zeolite Y or nickel on silica-alumina base. Typically the hydrcracking reaction is conducted at temperatures ranging about 600° F. to 750° F. and 500 to 1500 pounds per square inch pressure (psig) to produce a major quantity of the product as naphtha, and a lesser quantity of the product as JP-1A or JP-5 jet fuel, and diesel blend components. These jet fuels are high flash point distillates of the kerosene type.

The heating value of aviation turbine, or jet fuels, measured by their heat of combustion, directly influences the flying range and payload capacity of all aircraft. Heating value is governed by the chemical composition of the fuel, and changes in chemical composition, notably the relative concentrations of the aromatics and paraffins, may raise or lower the heat of combustion depending on the weight or value of each, respectively, of the fuel. The effectivness of a jet fuel depends primarily on the amount of heat energy released when it is burned. The fuel capacity of an airplane is limited by the weight, or volume, of the fuel it can carry to advantage. In jet turbine engines, notably in high flying supersonic aircraft, a high proportion of the gross load is fuel, and therefore in such aircraft the composition of the fuel can be particularly important. The amount of fuel which an operational aircraft can carry is volume limited, and hence the density of a fluid can be particularly important since a fuel containing greater BTU's per unit can be contained within a given volume by increasing the density of a fuel. For example, it has been suggested that an increase in the heat of combustion from 18,400 BTU/lb. to 18,900 BTU/lb. allows a 30 percent increase in payload. Hence, a higher density fuel can increase the payload, or distance which a volume limited operational aircraft can fly, by utilizing a fuel containing more BTU's per gallon within its fuel tanks.

There presently exits a need for higher density jet fuels, particularly for use in aircraft which are volume limited in the amount of fuel which can be advantageously carried. In particular, there exists need for a process which can commercially produce from relatively low value feedstocks higher density aviation fuels, especially fuels for use in high flying supersonic aircraft which are volume limited in the amount of fuel which can be carried to advantage.

OBJECTS

It is, accordingly, the primary object of this invention to fill these and other needs.

In particular, it is an object of this invention to provide a process for the conversion to high density jet fuel of highly aromatic low value feedstocks, especially feedstocks containing high concentrations of fused multi-ring aromatic and fused multi-ring hydroaromatic hydrocarbons, especially fused two-ring aromatic and hydroaromatic hydrocarbons.

A specific object is to provide a process for the conversion of a feed rich in fused two-ring aromatic and fused two-ring hydroaromatic hydrocarbons, notably light cat cycle oil, furnace oils, coal liquids, tar sands liquids, shale oil liquids, and the like to high density jet fuels.

THE INVENTION

These objects and others are achieved in accordance with the present invention embodying a process wherein a feed comprising an admixture of liquid hydrocarbon compounds, inclusive particularly of fused two-ring aromatic hydrocarbons or fused two-ring hydroaromatic hydrocarbons, or both, containing organic sulfur or organic nitrogen, or both, is contacted with hydrogen over a catalyst which contains one or more of a Group VIB or Group VIII metal (Periodic Table of the Elements, E. H. Sargent & Co., Copyright 1964 DynaSlide Co.), or compound(s) thereof, at conditions sufficient to hydrodesulfurize or hydrodenitrogenate, or both hydrodesulfurize and hydrodenitrogenate, said feed. The product which has been hydrodesulfurized or hydrodenitrogenated, or both hydrodesulfurized and hydrodenitrogenated, is then contacted as a feed with a fluorided platinum-on-alumina catalyst at conditions sufficient to hydrogenate the fused two-ring aromatic hydrocarbons, or fused two-ring hydrogenated aromatic hydrocarbons (to the extent they are unsaturated), or both, to naphthenes, and said hydrogenated product is then distilled to produce a high density jet fuel.

This invention is based in large part on the discovery that a low value process stream containing a high concentration of fused two-ring aromatics and hydroaromatics, with sulfur or nitrogen, or both, (i) can be hydrotreated in a first stage over a Group VIB or Group VIII metal catalyst, e.g., a cobaltmolybdenum, nickel molybdenum, nickel-tungsten catalyst or the like, and the sulfur or nitrogen, or both sulfur and nitrogen, removed therefrom, and (ii) the hydrodesulfurized/hydrodenitrogenated product then hydrotreated in a second stage over a highly active fluorided Group VIII metal-on-alumina catalyst at conditions sufficient to hydrogenate and saturate the fused two-ring aromatics and/or partially saturated fused two-ring hydroaromatics of said feed at high selectivity to naphthenes, without any significant conversion thereof to lower molecular weight hydrocarbons. The sulfur-containing and/or nitrogen-containing light cat cycle oil, or similar feed containing at least about 60 percent and greater fused two-ring aromatic or hydroaromatic hydrocarbons, or both, preferably from about 85 percent to about 100 percent, more preferably from about 85 percent to about 95 percent fused two-ring aromatic or hydroaromatic hydrocarbons, or both, based on the weight of the feed, and boiling within a range of from about 350° F. to about 700° F., preferably from about 400° F. to about 650° F., can be hydrotreated over a Group VIB and/or Group VIII metal catalyst at low severity in a first stage to remove the sulfur or nitrogen, or both. The low severity first stage reaction generally requires temperatures ranging from about 600° F. to about 775° F., preferably about 675° F. to about 725° F., hydrogen partial pressures ranging from about 200 psig to about 3000 psig, preferably from about 800 psig to about 1250 psig, feed rates ranging from about 0.2 V/Hr/V to about 10 V/Hr/V, preferably from about 0.5 V/Hr/V to about 2 V/Hr/V, and recycle hydrogen rates ranging from about 1000 SCF/B to about 10,000 SCF/B, preferably from about 4000 SCF/B to about 6000 SCF/B.

The liquid product from the first stage hydrotreater, after the separation of hydrogen sulfide or ammonia, or both, therefrom is then contacted, with hydrogen, in a second stage reactor over a fluorided Group VIII metal-on-alumina catalyst at low severity conditions sufficient to selectively hydrogenate the aromatics and hydroaromatics to produce naphthenes without significant conversion of the feed to lower boiling or lower molecular weight hydrocarbons. The density and BTU's of the fuel, per gallon of feed volume are lowered since aromatics are converted to naphthenes, but nonethless remain quite high as contrasted with the density and BTU values of parafinic fuels obtained from conventional sources, i.e., hydrocracking which forms paraffins by cleavage of aromatic carbon-carbon bonds. Suitably, this reaction is conducted at temperature ranging from about 300° F. to about 600° F., preferably from about 400° F. to about 500° F., hydrogen partial pressures ranging from about 200 psig to about 3000 psig, preferably from about 500 psig to about 1500 psig, feed rates ranging from about 0.5 V/Hr/V to about 10 V/Hr/V, preferably from about 1 V/Hr/V to about 2 V/Hr/V, and at recycle hydrogen gas rates ranging from about 2000 SCF/B to about 10,000 SCF/B, preferably from about 4000 SCF/B to about 6000 SCF/B. The conversion level to products boiling below 300° F. (i.e., 300° F.−) is maintained below about 5 percent, preferably below about 2 percent, based on the weight of feed introduced into the second stage hydrotreating unit. The volume of product obtained from the second stage reactor, based on the feed introduced into said second stage reactor, generally ranges above about 95 percent, preferably from about 99 percent to about 105 percent (due to volume expansion).

The highly active, hydrogenation selective catalyst employed in the second stage hydrotreater is a fluorided Group VIII metal-on-alumina catalyst composition where Group VIII refers to the Periodic Table of Elements (E.H. Sargent & Co., Copyright 1964 Dyna-Slide Co.). Platinum is the preferred Group VIII metal.

The fluorided Group VIII metal-on-alumina catalyst comprises about 0.1 to about 2 percent, preferably from about 0.3 to about 0.6 percent Group VIII metal and from about 2 percent to about 10 percent fluoride, preferably from about 5 percent to about 8 percent fluoride, based on the total weight of the catalyst composition (dry basis). It is to be understood that the alumina component of the catalyst may contain minor amounts of other materials, such as, for example, silica, and the alumina herein encompasses alumina-containing materials.

The preferred hydrogenation selective catalyst employed in hydrotreater R2 will have a fluoride concentration less than about 2.0 weight percent, preferably less than about 1.0 weight percent and most preferably less than 0.5 weight percent at its outer surface. The outer surface is measured to a depth less than one hundredths of an inch. The surface fluoride was measured by scanning electron microscopy. The remaining fluoride is distributed with the Group VIII metal at a depth below the outer shell into and within the particle interior.

The platinum contained on the alumina component of the preferred catalyst will preferably have an average crystallite size of up to 50 Å, more preferably below about 30 Å, and most preferably below about 25 Å.

A preferred hydrogenation selective catalyst is described by reference to application Ser. No. 134,796 by Glen P. Hamner and Willard H. Sawyer, filed Dec. 18, 1987; herewith incorporated in the present application by reference.

In the preferred embodiment of the invention, the catalyst used to hydrogenate the aromatic hydrocarbons will have high intensity peaks characteristic of aluminum fluoride hydroxide hydrate as well as the peaks normally associated with gamma alumina. X-ray diffraction data (X-ray Diffractometer, Scintag U.S.A.) show that the fluoride present in the preferred catalyst will be substantially in the form of aluminum fluoride hydroxide hydrate. In this connection, the relative X-ray diffraction peak height at $2\theta=5.66$ Å is taken as a measure of the aluminum fluoride hydroxide hydrate content of the catalyst. The 5.66 Å peak for a Reference Standard (hereinafter defined) is taken as a value of 100. For example, a fluorided platinum-on-alumina catalyst having a hydrate level of 60 would therefore have a 5.66 Å peak height equal to 60% of the 5.66 Å peak height of the Reference Standard, with a value of 80 corresponding to a catalyst having a 5.66 Å peak height equal to 80% of the 5.66 Å peak height of the Reference Standard etc. The preferred hydrogenation catalyst will have a hydrate level greater than about 60, preferably at least 80, and most preferably at least about 100.

The Reference Standard contains 0.6 wt. % Pt and 5.6 wt. % F on $\gamma$ alumina having a surface area of about 150 $m^2/g$. The Reference Standard is prepared by impregnation of an $\gamma$ alumina with platinum, followed by single contact with an aqueous solution of hydrogen fluoride (11.6 wt. % HF solution) with overnight drying at 300° F.

The Group VIII metal, preferably platinum, can be incorporated with the alumina in any suitable manner, such as by coprecipitation or co-gellation with the alumina support, or by ion exchange with the alumina support. In the case of a fluorided platinum-on-alumina catalyst, a preferred method for adding the platinum group metal to the alumina support involves the use of an aqueous solution of a water soluble compound, or salt of platinum to impregnate the alumina support. For example, platinum may be added to the support by co-mingling the uncalcined alumina with an aqueous solution of chloroplatinic acid, ammonium chloroplatinate, platinum chloride, or the like, to distribute the platinum substantially uniformly throughout the particle. Following the impregnation, the impregnated support can then be shaped, e.g., extruded, dried and subjected to a high temperature calcination, generally at a temperature in the range from about 700° F. to about 1200° F., preferably from about 850° F. to about 1000° F., generally by heating for a period of time ranging from about 1 hour to about 20 hours, preferably from about 1 hour to about 5 hours. The platinum component added to the alumina support, is calcined at high temperature to fix the platinum thereupon prior to adsorption of the fluoride.

Distribution of the fluoride on the catalyst is achieved by a single contact of the precalcined Group VIII metal, e.g., platinum, alumina composite with a solution which contains the fluoride in sufficiently high concentration. Preferably an aqueous solution containing a fluoride in high concentration is employed, a solution generally containing from about 10 percent to about 20 percent, preferably from about 10 percent to about 15 percent hydrogen fluoride. Solutions containing hydrogen fluoride in these concentrations will be adsorbed to incorporate most of the hydrogen fluoride, at an inner layer below the outer surface of the platinum-alumina particles.

The platinum-alumina composite, after adsorption thereupon of the fluoride component is heated during preparation to a temperature ranging up to but not exceeding about 650° F., preferably about 500° F., and more preferably 300° F. A characteristic of the inner platinum-fluoride containing layer is that it contains a high concentration of aluminum fluoride hydroxide hydrate. It can be shown by X-ray diffraction data that a platinum-alumina catalyst formed in such manner displays high intensity peaks characteristic of both alumina fluoride hydroxide hydrate and gamma alumina.

Feedstocks containing the said high concentrations of fused multi-ring aromatic or hydroaromatic compounds having predominantly two rings in the total molecule, or feeds which contain such compounds in admixture with other hydrocarbon compounds, are useful in accordance with this invention to produce high density jet fuels. Exemplary of fused two-rings aromatic and hydroaromatic compounds are naphthalene, or naphthalene derivatives, indene, or indene derivatives, and such hydroaromatics as tetralin, or tetralin derivatives, and indane, or indane derivatives. The preferred feeds are those which consist essentially of, or contain high concentrations of fused two-ring aromatic or hydroaromatic compounds boiling within a range of from about 300° F. to about 550° F., and more preferably those boiling within a range of from about 350° F. to about 525° F.

Such feeds can be readily hydrogenated in the process of this invention to a high density jet fuel having an API gravity (ASTM-D-287-67) ranging from about 25 to about 35, preferably from about 28 to about 33, with a total aromatic content well below about 50 percent down to about 5 percent which is the minimum aromatic content required to maintain swell of the o-ring seals presently employed in conventional jet engine fuel systems. Suitably, the total aromatic content of the high density jet fuel produced by this process ranges from about 0 to about 50 percent, preferably from about 5 percent to about 30 percent, more preferably from about 5 percent to about 20 percent, based on the total weight of the high density jet fuel. This high density jet fuel will meet all other specifications required for JP-5 grade jet fuel, but will have far greater density than JP-5 (which has an API gravity ranging from about 40 to 45).

The process of this invention will be better understood by reference to the following description of a specific and preferred embodiment, and to the drawing.

REFERENCE TO THE DRAWING

Referring to the drawing, the FIGURE exemplifies a simplified flow diagram depicting the steps of the process. Valves, pumps, compressors, separators, reboilers, and the like have been omitted from the FIGURE for clarity.

DETAILED DESCRIPTION OF THE INVENTION

Referring first to the FIGURE, there is depicted a hydrogenation reactor R-1 which is representative of one, or a series of hydrotreating reactors, which contains a hydrogenation catalyst over which a feed containing a high concentration of one or more fused two-ring aromatic hydrocarbons and/or the fully or partially hydrogenated derivatives thereof is contacted, in the presence of hydrogen, to remove heteroatoms from the feed, e.g., by breakage of carbon-sulfur and/or carbon-nitrogen bonds (and including carbon-oxygen bonds, if any) of the molecular species containing these heteroatoms, and hydrogen heal the sites of the broken bonds. This feed, and hydrogen, are thus introduced directly into R-1 as separate streams, or as an admixture of the feed with hydrogen. In conducting the hydrotreating operation, it is essential to reduce, or lower, the sulfur and nitrogen concentration, or both the sulfur and nitrogen concentrations, of the feed. This is accomplished in R-1, and completed by the use of interstage hydrogen sulfide and ammonia separators S-1 downstream and in series with R-1.

The feed introduced into R-1 is typically high in organo sulfur and organo nitrogen content, i.e., generally ranging from about 0.2 percent to about 3 percent organo sulfur and from about 0.02 to about 0.4 percent organo nitrogen, respectfully, or more typically from about 1 to about 2 percent organo sulfur and from about 0.03 to about 0.2 percent organo nitrogen, respectfully, based on the weight of the feed. The organo sulfur and organo nitrogen compounds are typically distributed throughout the boiling range of the total feed. Suitable feeds are those derived from petroleum sources these including catalytic heavy naphtha and light cycle oil from high severity cracking, furnace oil, steam cracker distillates, coil liquids and the like. Such feeds can be relatively high in aromatics, or high in in hydroaromatics, or both. They can contain, e.g., in excess of 60 volume percent aromatics, or up to about 95 volume percent aromatics, or greater, such as cycle oil obtained from cracking heavy petroleum fractions as gas oils, employing either a synthetic or natural zeolite catalyst. Suitable feedstocks can boil generally within a range of from about 320° F. to about 1050° F., preferably from about 400° F. to about 750° F.

Various hydrogenation catalysts known to the art can be employed in R-1. Such catalysts contain a metal, or metals, which provides a hydrogenation (hydrogen transfer) function. Suitably such catalysts are comprised one or more components selected from Group VI-B and VIII of the Periodic Table of the Elements composited with an alumina base, or support. The catalyst comprises at least one metal, metal oxide, or metal salt of, e.g., chromium, molybdenum, tungsten, iron, cobalt, nickel, ruthenium, rhodium, palladium, osmium, iridium, and platinum dispersed on a support. As is customary in the art of catalysts, when referring to a catalytically active metal, or metals, such reference is intended to encompass the existence of such metal in the elementary state or in the form of an oxide, sulfide, halide, or the like. Regardless of the state in which the metallic component actually exists, the concentrations are computed and reference is made to the metal as though it existed in its elemental state; regardless of the sate in which the metal actually exists. The support for the metallic component is usually a porous inorganic oxide, preferably alumina, or alumina in admixture with another porous, inorganic oxide. In general, the hydrogenation component is employed in concentrations ranging from about 0.1 to about 25 percent, preferably from about 0.3 to about 15 percent, based on the weight of the catalyst. Specific examples of preferred catalysts are, e.g., nickeltungsten-alumina, nickel-molybdenum-alumina, or the like.

The hydrotreating reaction in R-1 is conducted over such catalysts under conditions of temperature, pressure, hydrogen flow rate and liquid hourly space velocity, correlated to remove maximum amounts of sulfur or nitrogen, or both, with minimum conversion of the feed to lower boiling components. The temperature at which hydrogenation reactor R-1, or reactors, is operated generally ranges from about 600° F. to about 775° F., and preferably from about 675° F. to about 725° F. Temperatures are not particularly critical, but at temperatures below about 600° F., the rate of reaction is generally slower than necessary, and at temperatures above about 775° F. light gas formation in the product tends to increase markedly. The temperature used will also depend on the activity of the hydrotreating catalyst, higher temperatures being used with less active catalysts. The pressure in the hydrogenation reactor, or reactors, will generally range from about 200 psig to about 2000 psig, and more preferably ranges from about 800 psig to about 1250 psig. The liquid hourly space velocity in the reaction zone will generally range from about 0.2 V/Hr/V to about 10 V/Hr/V, preferably from about 0.5 V/Hr/V to about 2 V/Hr/V.

The flow of hyrdogen into the hydrogenation reactor, or reactors, is preferably maintained above about 1000 SCF/Bbl, generally from about 2000 to about 10,000 SCF/B, and more preferably within a range of from about 4000 to about 6000 SCF/Bbl. The hydrogen can be added to the feed prior to introduction of the feed into the hydrogenation reactor, or reactors, or can be added to the reactor, or reactors, separate from the feed. The hydrogen is passed through the reactor, or reactors, in contact with the catalyst on a once-through basis, or is recycled.

Hydrogen sulfide and ammonia, and water if any, must be removed from the product prior to introduction of the liquid effluent into the next reactor, R-2 of the series, and suitably this is accomplished by introduction of the product of R-1 into the interstage separator, or separators, viz. a flash drum S-1 which removes most of the sulfur and nitrogen. The product of S-1 is separated into fractions which include a gas which contains ammonia and hydrogen sulfide, and a low sulfur, low nitrogen high boiling liquid product which is removed from the bottom of S-1 and fed into hydrogenation reactor R-2. This bottoms product, which constitutes a feed for reactor R-2, generally contains less than about 20 wppm (parts per million, by weight) sulfur, preferably less than 5 wppm sulfur, and less than about 5 wppm nitrogen, preferably less than about 1 wppm nitrogen.

The hydrogenation reaction is conducted in R-2 under conditions of temperature, pressure, hydrogen flow rate and liquid hourly space velocity, correlated to hydrogenate the fused two-ring aromatic components of feed and convert same into naphthenes, and derivatives of naphthene; generally into derivatives of naphthenes which contain methyl and ethyl branches. The hydrotreating temperature in R-2 generally ranges from about 300° F. to about 600° F., and preferably from about 400° F. to about 500° F. The hydrogen partial pressure in R-2 will generally range from about 200 psig to about 3000 psig, and more preferably ranges from about 500 psig to about 1500 psig. Elevated pressures advantageously influence the rate and extent of hydrogenation, as well as extend the catalyst activity and life. The liquid hourly space velocity in reactor R-2 will generally range from about 0.5 V/Hr/V to about 10 V/Hr/V, preferably from about 1 V/Hr/V to about 2 V/Hr/V. The flow of hydrogen into the reactor, or reactors, is preferably maintained at from about 2000

SCF/B to about 10,000 SCF/B, and more preferably from about 4000 SCF/B to about 6000 SCF/Bbl.

The product of R-2 is passed into a distillate column D-1 and separated into fractions which include primarily a 300° F. to 550° F. high density jet fuel fraction, and 300° F.− and 550° F.+ fractions, the latter of which is blended with diesel fuel, or hydrocracked in another, or separate process to produce gasoline.

The high density jet fuel produced in accordance with the process of this invention is characterized by the following inspections, to wit:

| | Typical | | Preferred | |
|---|---|---|---|---|
| | Min. | Max. | Min. | Max. |
| Gravity, °API | 25 | 35 | 28 | 33 |
| Flash, °F. | 100 | 200 | 120 | 160 |
| Sulfur, ppm | 1 | 10 | 1 | 5 |
| Nitrogen, ppm | 0.1 | 5 | 0.2 | 1 |
| Freeze Pt., °F. | −45 | −80 | −50 | −60 |
| Aromatics, Vol % | 0.5 | 50 | 5 | 35 |
| Olefins, Vol % | | 3 | | |
| Hydrogen, Wt % | 11.5 | 14 | 11.9 | 13.5 |
| Thermal Stability | | | | |
| JFTOT Test @ 500° F. | pass | | | |
| Pressure Drop | 0 to 4 | | 0 to 2 | |
| Tube Rating | 0 to 3 | | 0 to 2 | |
| Net Heat of Combustion | | | | |
| BTU per lb. | 18,300 to 18,500 | | 18,350 to 18,400 | |
| BTU per gal | 130,000 to 134,000 | | 131,000 to 133,000 | |

| | Typical | | | | Preferred | | | |
|---|---|---|---|---|---|---|---|---|
| | Min. | Max. | Min. | Max. | Min | Max. | Min. | Max. |
| Distillation. °C. | | | | | | | | |
| Initial | 150–190° C. | | (302–374° F.) | | 170–180° C. | | (338–356° F.) | |
| @ 10% | 200–240° C. | | (392–464° F.) | | 210–200° C. | | (410–428° F.) | |
| @ 50% | 220–260° C. | | (430–500° F.) | | 220–240° C. | | (428–464° F.) | |
| @ 90% | 250–270° C. | | (482–518° F.) | | 255–260° C. | | (490–500° F.) | |
| F.B.P. | 270–300° C. | | (518–572° F.) | | 270–290° C. | | (518–554° F.) | |

The invention will be more fully understood by reference to the following examples and demonstrations illustrating its more salient features. Parts are expressed in terms of weight units except as otherwise stated.

EXAMPLE 1

A liquid product was obtained from a refinery stream resultant from the contact, and reaction of a light cat cycle oil (LCCO) feed, and hydrogen, over a nickel-molybdenum catalyst, with subsequent separation of hydrogen sulfide and ammonia from the liquid product in an intermediate separator. The liquid product is thus as produced by reaction of an LCCO feed in R-1, after separation of hydrogen sulfide and ammonia, as defined by reference to the FIGURE.

The liquid product, from which sulfur and nitrogen has been removed, was employed as a feed to a second reactor (R-2) to produce, besides lighter boiling and heavier boiling liquids, a high density jet fuel, first for comparative purposes, by contact and reaction, with hydrogen over a palladium hydrogen substituted Y zeolite catalyst (Pd-H-Y) and then at similar conditions by contact, and reaction, with hydrogen over a platinum fluoride alumina catalyst (Pt-F-$Al_2O_3$). Inspections on the desulfurized/denitrogenated liquid product (from R-1) used as a feed (to R-2) are given in Table 1A as follows:

TABLE IA

| Inspections | |
|---|---|
| °API | 25 |
| Sulfur, ppm | 20 |
| Nitrogen, ppm | 5 |
| Aromatics, Wt. % | 63.3 |
| Vol. % | 60.2 |
| Distillation, °F. (ASTM D-86) | |
| 1st BP | 200 |
| 10 | 402 |
| 50 | 515 |
| 90 | 605 |
| FBP | 660 |

The conditions under which the reactions were carried out in the second reactor (R-2), the amount of hydrogen consumption, product yield (based on feed to the second reactor), and inspections on the high density jet fuel produced by each of the catalyst are given in Table 1B, along with certain physical properties of the liquid product from said first reactor which was employed as a feed to said second reactor.

TABLE IB

| | Catalyst | | | R-1 |
|---|---|---|---|---|
| | Pd—H—Y | Pt—F—$Al_2O_3$ | | Product |
| Process Conditions | | | | |
| Temperature, °F. | | 550 | | |
| V/V/Hr | 1 | 1 | 2 | |
| Pressure, psi | | 1000 | | |
| Hydrogen Consumption, SCF/Bbl | 1722 | 1345 | 1112 | |
| Yield in R-1 Product ex $H_2S/NH_3$, Wt. % | | | | R-1 |
| $C_3$ and lighter | 1.7 | 0.1 | 0.1 | |
| $C_4$ | 7.2 | 0.1 | 0.1 | |
| $C_5$-320° F. | 56.4 | 1.3 | 1.1 | 0.6 |
| 320–550° F. | 33.1 | 65.7 | 60.9 | 59.1 |
| 550° F.+ | 4.3 | 33.0 | 39.8 | 40.3 |
| Hi-density Jet Fuel | | | | |
| °API | 39.3 | 33.6 | 31.5 | 25.0 |
| Freeze Pt, °F. | −29 | −49 | −45 | N.D. |
| Aromatics, Vol. % | 26.3 | 4 | 13.6 | 63.3 |
| Sulfur, ppm | nil | nil | nil | 20 |
| Nitrogen, ppm | <1 | <1 | <1 | 5 |

The data shows clearly that the Pt—F—$Al_2O_3$ catalyst produces maximum yields of jet fuel of higher density with a corresponding lower aromatics content than that obtained with the zeolite base catalyst. Moreover, it is clear that a more efficient utilization of hydrogen is also obtained with the Pt—F—$Al_2O_3$ catalyst.

The following exemplifies the production of a high density jet fuel from an R-2 feed comprised of a blend of desulfurized/denitrogenated LCCO (55 Vol. %) and coker gas oil (45 Vol. %). The process is otherwise conducted as in the preceding example.

EXAMPLE 2

The process conditions, hydrogen consumption, product yield based on feed to the second reactor, and inspections on the high density jet fuel produced by each of the catalysts, respectively, employed in the preceding example are given in Table 2, along with certain inspections made on the feed to said second reactor R-2.

TABLE 2

| | Catalyst | | | R-1 |
|---|---|---|---|---|
| | Pd—H—Y | Pt—F—$Al_2O_3$ | | Product |
| Process Conditions | | | | |
| Temperature, °F. | 475 | 440 | 500 | |
| V/V/Hr | 1 | 1 | 2 | |
| Pressure, psi | 1000 | 1000 | | |
| Hydrogen Consumption | | | | |
| SCF/Bbl | 1677 | 980 | 893 | |
| Yield on R-1 Product Ex $H_2S/NH_3$, Wt. % | | | | |
| $C_3$ and lighter | 0.8 | 0.1 | 0.1 | |
| $C_4$ | 2.2 | 0.1 | 0.1 | |
| $C_5$-320° F. | 15.2 | 0.7 | 0.6 | 0.5 |
| 320–550° F. | 60.2 | 60.7 | 59.2 | 57.5 |
| 550° F.+ | 26.3 | 40.1 | 41.5 | 42.0 |
| Hi-density Jet Fuel | | | | |
| °API | 36.6 | 33.8 | 33.5 | 26.0 |
| Freeze Pt. °F. | −39 | −39 | −39 | N.D. |
| Aromatics, Vol. % | 15.7 | 13.1 | 16.2 | 68.9 |
| Sulfur, ppm | nil | nil | nil | 2 |
| Nitrogen, ppm | <1 | <1 | <1 | 1 |

The Pt—F'$Al_2O_3$ catalyst as will be observed produces equivalent yield without light ends production and a higher density for equivalent aromatics content, as well as a corresponding improved hydrogen utilization in producing a high density jet fuel.

The following exemplifies a process for the production of high density jet fuel from an R-3 product, differing from Example 2 previously exemplified in that a 350° F.+fraction, in this instance the 200°–540° F. fraction from R-2 is reacted as a feed in an additional reactor R-3 which contains a Pt-F-$Al_2O_3$ catalyst.

EXAMPLE 3

Example 1 was repeated except that in this instance the 200°–540° F. fraction obtained as a heart cut fraction from the reactor (R-2) was reacted at low pressure in a third reactor R-3 over the Pt—F—$Al_2O_3$ and Pd—H—Y catalysts employed in the preceeding examples with process conditions sufficient to produce an aromatic product of less than 35 percent without conversion to naphtha. The process conditions, hydrogen consumption, product yield based on the R-3 feed, inspections on the high density jet fuel product, and certain inspections made on the R-3 feed are given in Table 3.

TABLE 3

| | Catalyst | | |
|---|---|---|---|
| | Pt—F—$Al_2O_3$ | Pd—H—Y | Feed |
| Process Conditions | | | |
| Temp. °F. | 420 | | |
| V/V/Hr. | 1 | | |
| Pressure, psig | 250 | | |
| Hydrogen Consumption, SCF/B | 982 | 975 | |
| Yield on Feed, wt % | | | |
| $C_3$ & Lighter | 0.09 | .08 | |
| $C_4$ | 0.08 | .13 | |
| $C_5$-320° F. | 9.2 | 13.4 | 9.4 |
| 320–550° F. | 92.2 | 87.1 | 90.6 |
| Stat. Liquid Inspection | | | |
| Gravity, °API | 35.3 | 36.5 | 30.5 |
| Vol. % Aromatics | 31.9 | 31.7 | 71.4 |
| High Density Jet Fuel (320–500° F.) | | | |
| Gravity, °API | 34 | 35.2 | 29.0 |
| Freeze Pt. °F. | −42 | −56 | N.D. |
| Aromatics, vol. % | 31.5 | 31.4 | 72 |
| Sulfur, ppm | nil | nil | 2 |
| Nitrogen, ppm, | <1 | nil | 2 |
| Hydrogen, wt % | 12.88 | 12.91 | 11.42 |

Pt—F—$Al_2O_3$ catalyst, as shown, selectively hydrogenates aromatics at low pressure to produce a satisfactory high density jet fuel, without conversion and loss of jet fuel components to lighter products.

It is apparent that various modifications and changes can be made without departing from the spirit and scope of the invention.

Having described the invention, what is claimed is:

1. A process for the production of high density jet fuel which comprises, (A) contracting with hydrogen, in a first stage, a feed comprising (a) sulfur-containing compounds, nitrogen-containing compounds, or mixtures thereof, and (b) at least about 60 percent, based on the total weight of the feed, of liquid hydrocarbon compounds inclusive of fused two-ring aromatic hydrocarbons, hydrogenated fused two-ring aromatic hydrocarbons, or mixtures thereof, over a catalysts which contains one or more of a Group VIB or Group VIII metal, or both Group VIB and Group VIII metals, or compound thereof, at hydrotreating conditions sufficient to hydrodesulfurize or hydrodenitrogenate, or both hydrodesulfurize and hydrodenitrogenate, said feed;

(B) separating and removing sulfur or nitrogen, or both sulfur and nitrogen, from the product of said first stage to produce a liquid product which contains no more than about 20 wppm sulfur, or no more than about 5 wppm nitrogen:

(C) contacting, in a second stage, the liquid product from step (B) with hydrogen, over a fluorided Group VIII metal-on-alumina catalyst to hydrogenate said fused two-ring aromatic hydrocarbons or hydrogenated fused two-ring hydrocarbons of said feed to selectively hydrogenate said aromatic or hydroaromatic hydrocarbons to naphthenes without conversion to lower boiling, lower molecular weight hydrocarbons of the liquid product of step (B) in excess of about 5 percent, based on the weight of said liquid product of step (B);

(D) withdrawing from said second stage a volume of product, based on the product of said first stage fed into second stage, above about 95 percent; and (E) separating from the product of said second stage hydrogenation reaction a high density jet fuel having a gravity ranging between about 25 API and 35 API, and an aromatic concentration below about 50 percent, based on the total weight of said jet fuel.

2. The process of claim 1 wherein the Group VIII metal on the fluorided Group VIII metal-on-alumina catalyst is platinum.

3. The process of claim 2 wherein the fluorided platinum-on-alumina catalyst contains an aluminum fluoride hydrate level greater than 60 where an aluminum fluoride hydroxide hydrate level of 100 corresponds to the X-ray diffraction peak height at 5.66 Å for a Reference Standard.

4. The process of claim 3 wherein the first stage hydrotreating operation is conducted at conditions defined as follows:

| | |
|---|---|
| Temperature, °F. | about 600 to 775 |
| $H_2$ Partial Pressure, psig | about 200 to 2000 |
| Feed rate, V/Hr/V | about 0.2 to 10 |
| Recycle hydrogen gas rate | about 1000 to 10,000 |

and wherein the second stage hydrogenation operation is conducted at conditions, sufficient to produce said high density jet fuel, defined as follows:

| | |
|---|---|
| Temperature, °F. | about 300 to 600 |
| $H_2$ Partial Pressure, psig | about 200 to 2000 |
| Feed rate, V/Hr/V | about 0.5 to 10 |
| Recycle hydrogen gas rate | about 2000 to 10,000 |

5. The process of claim 4 wherein the hydrocarbon admixture introduced as a feed into the first stage is comprised of from about 85 percent to about 100 percent of said fused two-ring aromatics and hydroaromatic hydrocarbons.

6. The process of claim 5 wherein the fluorided platinum-on-alumina catalyst has a fluoride concentration less than about 2.0 weight percent at the outer surface to a depth less than one hundredth of an inch.

7. The process of claim 6 wherein the fluorided platinum-on-alumina catalyst has an aluminum fluoride hydroxide hydrate level of at least 80.

8. The process of claim 7 wherein the first stage hydrotreating operation is conducted at conditions sufficient to reduce the sulfur concentration of the liquid product, after interstage separation, to about 5 wppm, and less, and the nitrogen concentration to about 1 wppm and less, or both the sulfur concentration to about 5 wppm and less and the nitrogen concentration to about 1 wppm and less, as follows:

| | |
|---|---|
| Temperature, °F. | about 675 to 725 |
| $H_2$ Partial Pressure, psig | about 800 to 1250 |
| Feed rate, V/Hr/V | about 0.5 to 2 |
| Recycle hydrogen gas rate | about 4000 to 6000 |

9. The process of claim 8 wherein fluorided platinum-on-alumina catalyst is comprised of from about 0.3 percent to about 0.6 percent platinum, from about 5 percent to about 8 percent fluoride.

10. The process of claim 9 wherein the second stage hydrotreating operation is conducted at conditions given as follows:

| | |
|---|---|
| Temperature, °F. | about 400 to 500 |
| $H_2$ Partial Pressure, psig | about 500 to 1500 |
| Feed rate, V/Hr/V | about 1 to 2 |
| Recycle hydrogen gas rate | about 4000 to 6000 |

11. The process of claim 10 wherein the second stage hydrotreating operation is conducted at conversion level sufficient to maintain the production of 300° F.− products below about 2 percent.

12. The process of claim 6 wherein the fluorided platinum-on-alumina catalyst has an aluminum fluoride hydroxide hydrate level of at least about 100.

13. The process of claim 1 wherein the feed to the first stage contains from about 85 percent to about 100 percent fused two-ring aromatic or hydroaromatic hydrocarbons, or both.

14. The process of claim 13 wherein the feed to the first stage contains from about 85 percent to about 95 percent fused two-ring aromatic or hydroaromatic hydrocarbons, and boils within a range of from about 350° F. to about 700° F.

15. The process of claim 1 wherein the high density jet fuel is one having a gravity ranging from about 28 API to about 33 API, and an aromatic concentration ranging from about 5 percent to about 30 percent.

16. The process of claim 15 wherein the high density jet fuel has an aromatic concentration ranging from about 5 percent to about 20 percent.

* * * * *